US006330766B1

(12) United States Patent
Brownlee, III

(10) Patent No.: US 6,330,766 B1
(45) **Date of Patent: *Dec. 18, 2001**

(54) DWELLING STRUCTURE ADAPTED TO ENCLOSE AN OVERSIZED VEHICLE

(76) Inventor: John A. Brownlee, III, 380 Beadling Rd., Pittsburgh, PA (US) 15228

( * ) Notice: Subject to any disclaimer, the term of this patent is extended or adjusted under 35 U.S.C. 154(b) by 0 days.

This patent is subject to a terminal disclaimer.

(21) Appl. No.: 09/224,470

(22) Filed: Dec. 31, 1998

Related U.S. Application Data

(60) Provisional application No. 60/070,252, filed on Dec. 31, 1997.

(51) Int. Cl.[7] ..... E04D 13/18

(52) U.S. Cl. ..... 52/173.1; 52/67; 52/79.8; 52/175; 52/185; 296/216; 414/227; 414/401

(58) Field of Search ..... 52/79.1, 79.7, 52/79.8, 64, 65, 67, 185, 143, 123.1, 236.3, 173.1, 175; 414/227, 233, 234, 239, 240, 261, 401; 296/216, 219, 156, 165, 171

(56) References Cited

U.S. PATENT DOCUMENTS

| | | | | |
|---|---|---|---|---|
| 4,078,343 | * | 3/1978 | Moore, Jr. | 52/79.1 |
| 4,499,696 | * | 2/1985 | Freeauf | 52/79.8 |
| 4,759,158 | * | 7/1988 | Aubry | 52/79.2 |
| 5,809,704 | * | 9/1998 | Stewart et al. | 52/169.4 |

* cited by examiner

*Primary Examiner*—Carl D. Friedman
*Assistant Examiner*—Yvonne M. Horton
(74) *Attorney, Agent, or Firm*—Christopher Ricci

(57) ABSTRACT

A dwelling system having a housing for enclosing an oversized vehicle where the oversized vehicle is generally an oversized vehicle such as a large truck, a recreational vehicle or a mobile home, for example. In one embodiment, the housing uses oversized doors with mock doors and windows such that the oversized garage enclosure is externally concealed. In another embodiment, the garage includes components that are vertically actuable so as to accommodate ingress and egress of an oversized vehicle.

6 Claims, 7 Drawing Sheets

DWELLING STRUCTURE ADAPTED TO ENCLOSE AN OVERSIZED VEHICLE

This application claims benefit of provisional application No. 60/070,252, filed Dec. 31, 1997.

BACKGROUND OF THE INVENTION

The present invention relates generally to apparatus and methods for enclosing an oversized vehicle. More particularly, the invention relates to an apparatus and method for enclosing an oversized vehicle within a housing structure such that the oversized vehicle is fully enclosed within the housing structure.

Motor Homes, recreational vehicles ("oversized vehicles") and mobile homes, collectively referred to as "oversized vehicles," have recently enjoyed an increase in popularity. Oversized vehicles provide a spontaneous mobility that is relatively inexpensive as opposed to a fixed dwelling which is generally more expensive and is immovable. The fixed dwelling, however, provides the owner a relatively spacious living area and is a welcome addition to most communities. In contrast, oversized vehicles are generally not welcomed into residential neighborhood and are considered as detrimental to the general appearance of such a neighborhood.

In addition, dump trucks, tractors, and other types of commercial vehicles can be too large to fit within conventional garages, they too are not welcomed in residential neighborhoods.

While oversized vehicles may be practical for use in campgrounds or in commercial settings, often times there are local ordinances and subdivision restrictions that do not allow oversized vehicles visibly located on residential lots. Further, there are often residential zoning requirements which limit the size of a garage and the size of the garage door that can be used. And, since an oversized vehicle is by definition a large vehicle, housing the oversized vehicles within a standard residential garage is not an option.

Accordingly, it is an object of this invention to provide a structure that accepts the oversized vehicle such that it is fully enclosed therein.

It is a further object of this invention to provide an oversized vehicles and dwelling combination that will fit in oversized vehicles parks.

These and other objects of the invention will be obvious and will appear hereinafter.

SUMMARY

The aforementioned and other objects are achieved by the invention which provides a dwelling system and a method associated therewith. The dwelling system comprises an oversized vehicle and a housing.

The oversized vehicle is generally a vehicle which is mobily disposed and is larger than what a conventional residential garage will accept. Examples of such oversized vehicles are recreational vehicles and mobile homes.

Generally, the housing has one or more rooms and is optionally a structure in which one or more people could dwell therein. The housing is adapted to be fully enclosed within the housing and is not visible from an external portion of the housing.

In further aspects, the invention provides methods in accord with the apparatus described above. The aforementioned and other aspects of the invention are evident in the drawings and in the description that follows.

BRIEF DESCRIPTION OF THE DRAWINGS

The foregoing and other objects of this invention, the various features thereof, as well as the invention itself, may be more fully understood from the following description, when read together with the accompanying drawings in which.

DETAILED DESCRIPTION

While the present invention retains utility within a wide variety of dwelling systems and may be embodied in several different forms, it is advantageously employed in connection with recreational vehicles and mobile homes. Though this is the form of the preferred embodiment and will be described as such, this embodiment should be considered illustrative and not restrictive. One skilled in the art will realize that the invention is useful with any type large vehicle that may not readily fit into a conventional garage. Therefore, as used herein, the term "oversized vehicles" shall be defined as any such vehicle without limitation. Further, illustrated and described herein is a structure that mates directly with the oversized vehicle. One skilled in the art will realize that no such mating need be performed to accomplish the goals of the invention.

Figure 1:
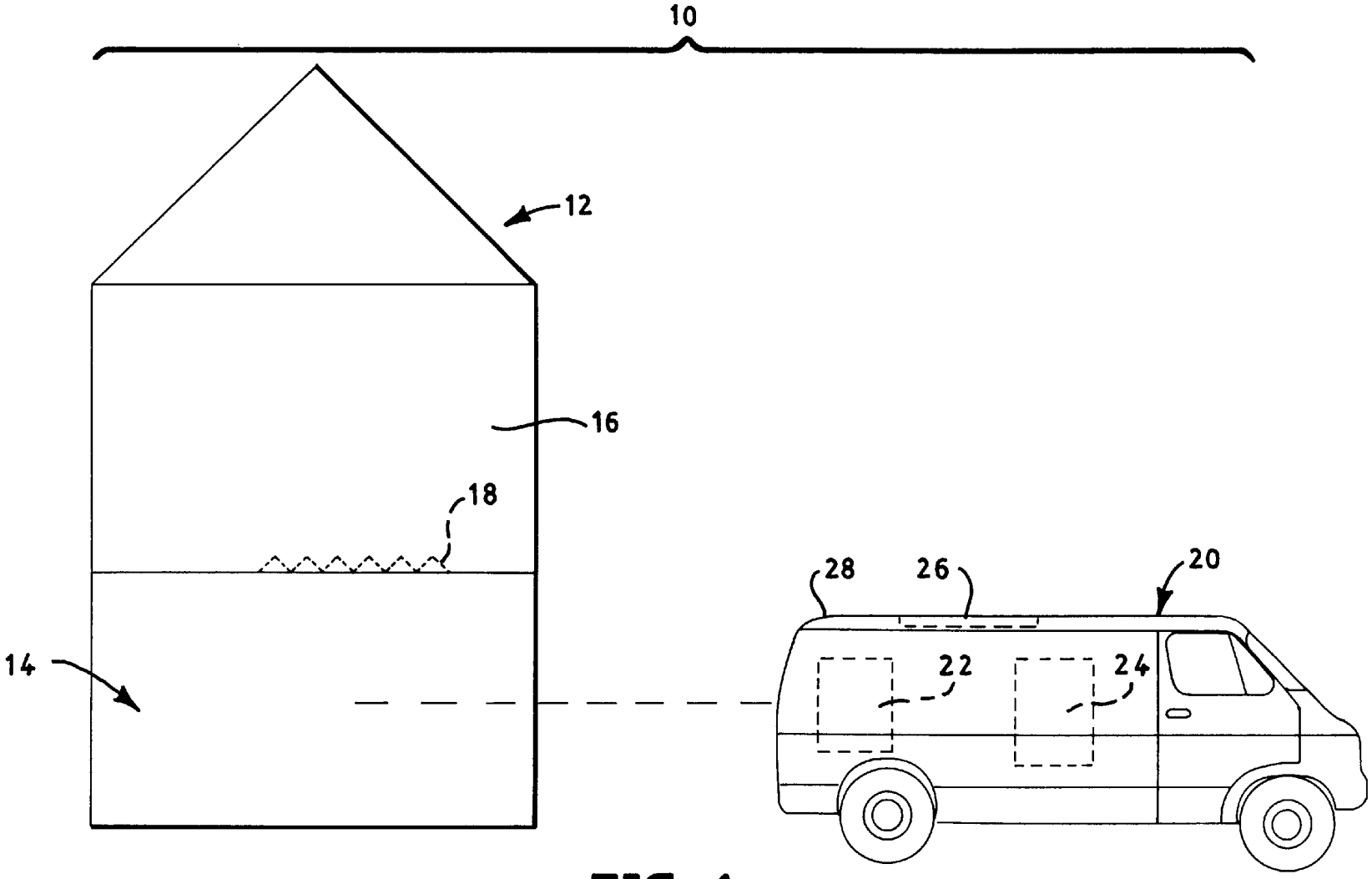
FIG. 1 shows an cross-sectional view of the dwelling system of the invention.

FIG. 1 shows a cross sectional view of the dwelling system 10 where a housing 12 is adapted to receive an oversized vehicle 20. In this embodiment, the housing 12 is structured so as to receive the oversized vehicle 20 below a living area 16. The housing is, in this embodiment, sized to accommodate the oversized vehicle 20 below the living area 16. The housing 12, and therefore the living area 16, can then be sized to maximize the square footage of living space given the lot size.

Figure 2:
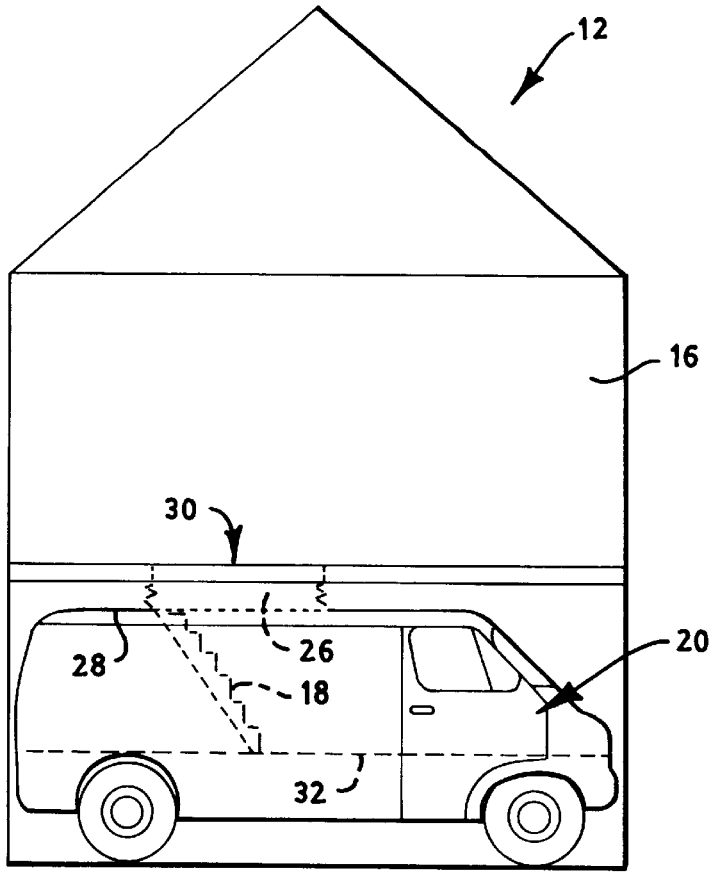
FIG. 2 shows a side view of the oversized vehicle disposed under a housing as per the invention.

In one embodiment, access to the oversized vehicle 20 is achieved through the floor of the housing 12 through the roof 28 of the oversized vehicle 20. While the invention is not limited to any particular method of ingress and egress, this embodiment allows the housing 12 to not require plumbing or other amenities which can be used within the oversized vehicle 20. Referring to FIGS. 1 and 2, access to the oversized vehicle 20 from the housing 12 achieved through an access way 26 disposed in a roof 28 of the oversized vehicle 20. The access way 26 has a weather tight door which when in a normally closed position seals the interior of the oversized vehicle 20 from external elements. In other embodiments, however, the need for a weather proof door would be unnecessary. For example, the housing 12 could be accessed by exiting the oversized vehicle 20 from a side door and then using an access way, such as stairs, offset to a side of the oversized vehicle 20 to enter the housing 12. In such an embodiment during entry into a living area 16, the occupants would be protected from external elements from above, but not from the side. Other offset forms of access ways should be readily apparent.

When using the door on the roof 28, however, the access way 26 is retractable in any of numerous ways well known in the art to open the access way 26.

Once the access way 26 is open, a mating structure 18, such as the stairs which are illustrated for example, can pass therethrough. One skilled in the art will realize that any structure that provides vertical access can serve as the mating structure 18. Other examples are telescoping ladders and elevators. The mating structure 18 is retractable into the housing 12 and is lockable in that position to insure security to the housing 12. The method of retraction is again design specific and ranges from a manual spring-biased structure to a structure having electric motors to cause retraction and engagement, for example. In the preferred embodiment, each such mating structure 18 can be locked, and in one embodiment engaged, using a key at ground level.

For homes that are known to be unoccupied for long periods of time, an elevated and lockable mating structure 18 is a desirable element of security. If the mating structure 18 is the primary means of ingress, an intruder would need a ladder to enter the housing 12, thus becoming highly visible thereby discouraging such actions.

When the mating structure 18 is unlocked, a force moves the mating structure 18 into an engaged position. In the illustrated embodiment, the mating structure 18 is a flight of stairs which is rotatably connected at one end to the housing 12. The force is manual and is actuated by pulling a rope from below or pushing down from above, though electric motors can be substituted without detriment to the invention.

Actuation as described causes the mating structure 18 to rotate about the hinges. Once fully engaged, the mating structure 18 locks in position.

In the engaged position, the mating structure 18 is in mechanical contact with a floor 32 of the oversized vehicle 20. Occupants of the living area 16 then access the facilities of the oversized vehicle 20 by walking down the mating structure 18 into the oversized vehicle 20. Examples of such facilities would be sanitary facilities 22, such as a toilet and a sink and a kitchen area 24. Since the facilities that require plumbing such as the sanitation facilities 22 are disposed within the oversized vehicle 20, the housing 12 need not have plumbing. Thus, the requirement of winterizing the housing 12 when the housing 12 is unoccupied for any long period of time is avoided.

The above-described embodiment shows a means by which the oversized vehicle 20 is accessed from the housing 12 and the space necessary for the mechanical interconnection of the two dwellings is minimized. However, the oversized vehicle 20 in that embodiment is fully exposed to passersby.

Figure 3:
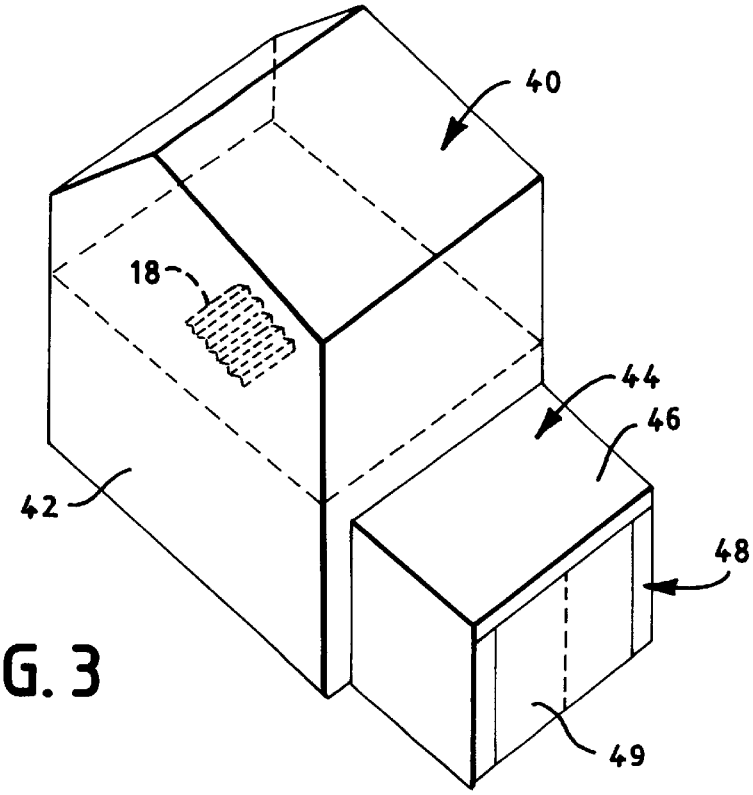
FIG. 3 shows a perspective view of the housing of the invention where the oversized vehicle is larger than a width of the housing.

FIG. 3 illustrates an embodiment where the oversized vehicle 20 is fully enclosed within the housing 40. However, since zoning laws often limit the size of a garage door in residential areas, the invention provides for a system by which access can still be achieved while maintaining the appearance of standard-size garage doors.

Another problem addressed in this embodiment is the overall length of the oversized vehicle 20. The length of the oversized vehicle 20 is commonly on the order of twenty-four feet long. This length can exceed the width of the housing 40. To manage the additional width of the oversized vehicle 20, a garage addition 44 extends from the housing 40. The enclosed space below the living area 16 and the area enclosed by the garage addition 44 define a chamber 42 where the oversized vehicle 20 is ultimately stored.

Figure 4A:
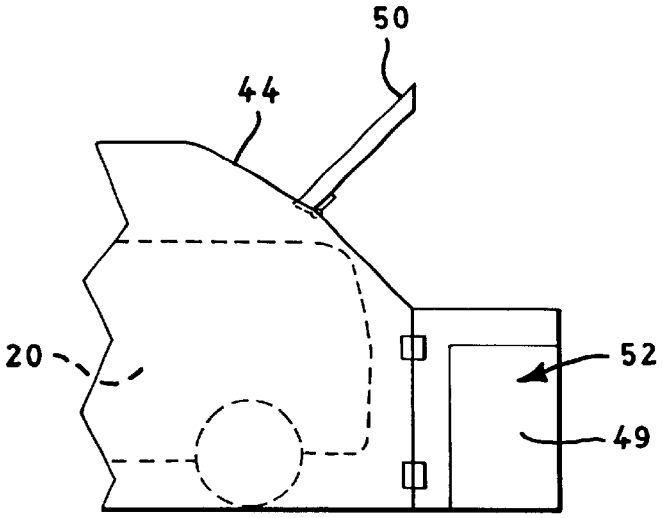
FIG. 4A shows a side view of a retractable entryway into the housing with an open doorway.
Figure 4B:
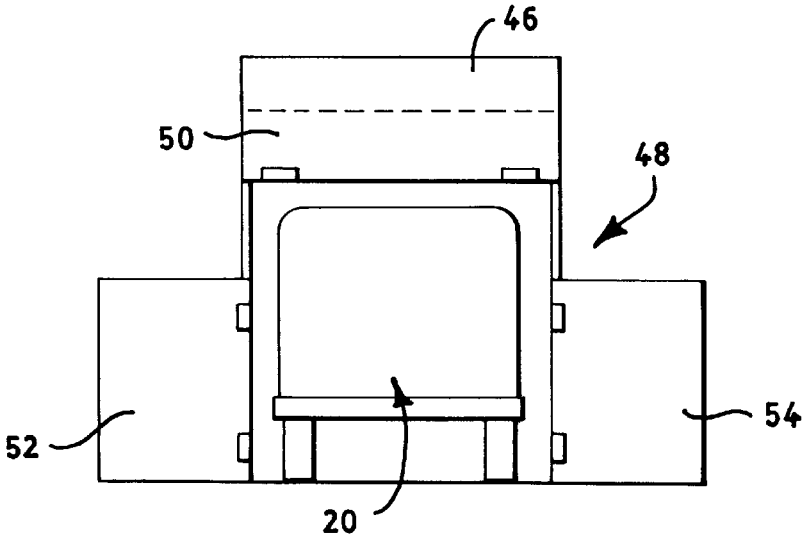
FIG. 4B shows a front view of a retractable entryway into the housing with an open doorway.

The garage addition 44 consists primarily of a roof 46 and an entryway 48. Referring now to FIGS. 4A and 4B with continuing reference to FIG. 3 the entryway 48 opens to allow access to the oversized vehicle 20. A mock garage door 49, however, is the size of a standard garage door. In the preferred embodiment, the mock garage door 49 is an operable garage door. Access through the entryway 48 is accomplished by using a two-part door system 52, 54 which is rotatably hinged about lateral surfaces of the garage addition 44. Additionally, at least a portion 50 of the roof 46 is rotatably disposed relative to the roof 44, thereby allowing the oversized vehicle 20 with its additional height to enter into what would otherwise have been a smaller opening. To reiterate, a first door 52, a second door 54 and at least a portion 50 of the roof 46 each rotate about hinges to allow entry of the oversized vehicle 20 into the chamber 42.

Figure 5:
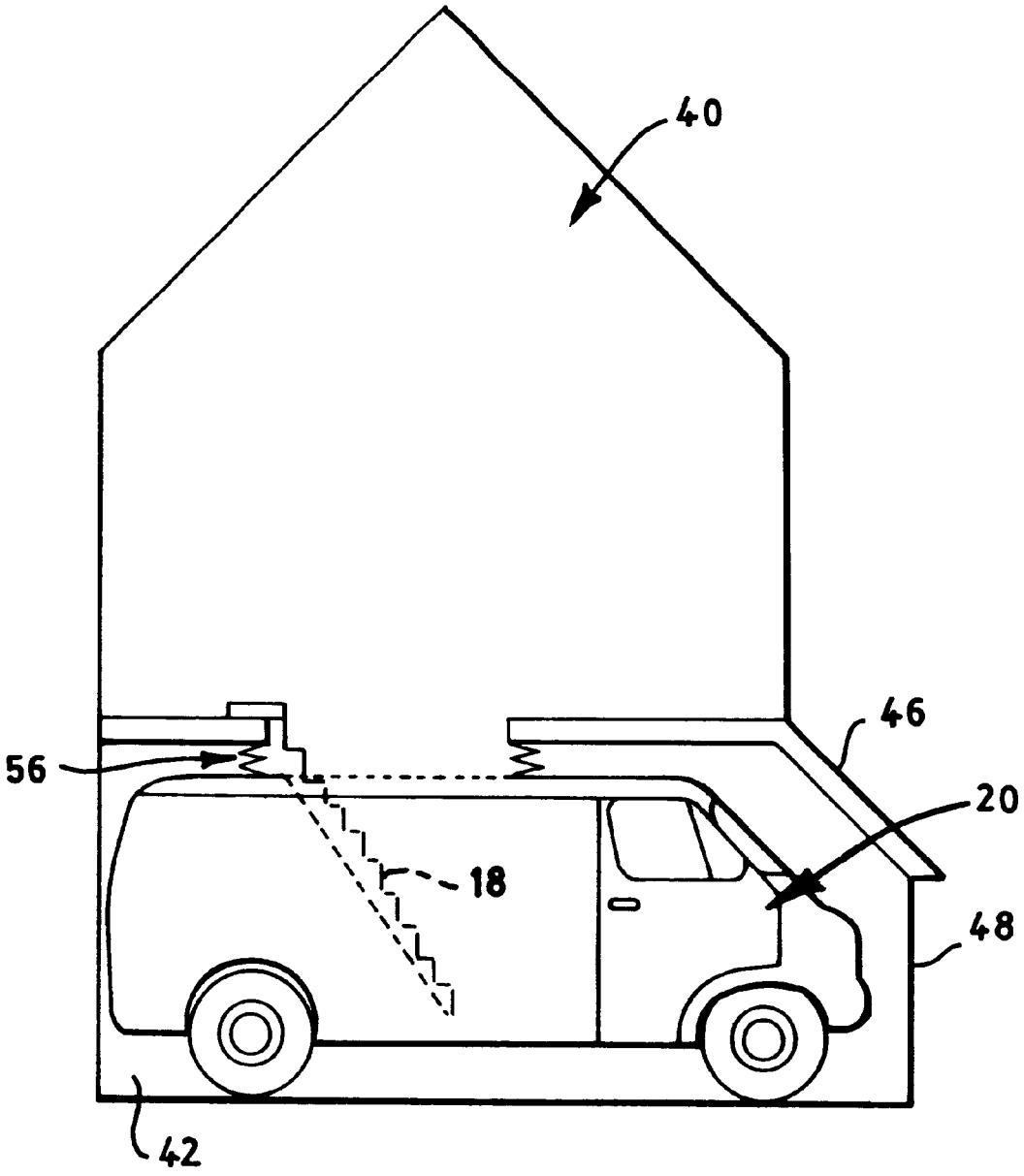
FIG. 5 shows a cross-sectional view of the dwelling structure where the oversized vehicle is disposed within the housing.

Referring now to FIG. 5, as previously discussed, the chamber 42 fully encloses the oversized vehicle 20 therein. In one embodiment, access to the oversized vehicle 20 is then as is commonly achieved for typical automobiles. That is, the occupants exit the vehicle through a side door of the oversized vehicle and enter the housing 40 through a door in the housing 40. In this embodiment, the housing is a fully functional dwelling that may be a permanent home having plumbing and sanitation facilities disposed therein. Compliance with relevant regulations is achieved in that the only "garage door" is the mock garage door 49 which is to code and the oversized vehicle 20 is not otherwise externally visible. As will be shown later herein, this purpose can also be achieved with a housing structure disposed adjacent to the chamber 42.

In another embodiment, the mating structure 18 retractably engages the oversized vehicle 20 and establishes the mechanical interconnection as was previously described. Also shown in this embodiment is an accordion-like structure 56 which provides a substantially airtight seal between the oversized vehicle 20 and the housing 40. This accordion like structure 56 ensures that a heating system disposed within the housing 40 or within the oversized vehicle 20 can heat the structure not having such a system if necessary. Further, an air conditioning system disposed in the housing 40 or oversized vehicle 20 can cool the other without significant thermal loss to the environment.

Figure 6:
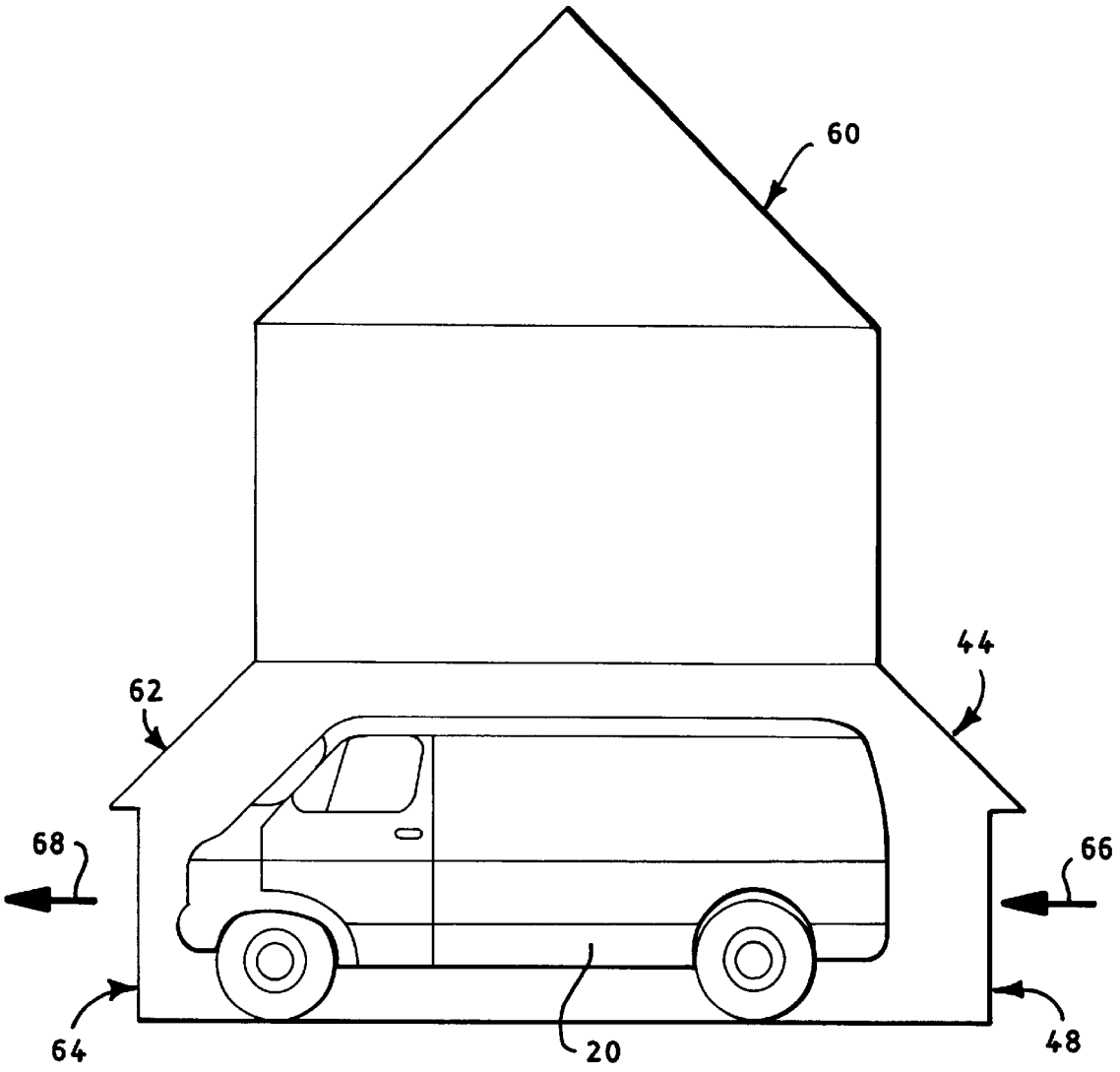
FIG. 6 shows a cross-sectional view of a housing which is adapted to have an entry at one end and an exit at another end.

In FIG. 6, a housing 60 is shown having a garage addition 44 as previously described including an entryway 48 which is hinged to allow forward access 66. Thus, in a manner similar to the previous embodiment, the entryway 48 opens to allow the oversized vehicle 20 to become fully enclosed in the housing 60 and again the mating structure 18 within the housing 60 engages the oversized vehicle 20 such that a mechanical interconnection is achieved. In contrast to the previous examples, however, the housing 60 includes a second garage addition 62 having an exit way 64. The exit way 64 is adapted to open similar to that of the entryway 48 where a first and a second door rotate as well as a portion of the roof. The exit way 64 then allows the oversized vehicle 20 to drive forward thereby providing for a forward egress 68.

Figure 7A:
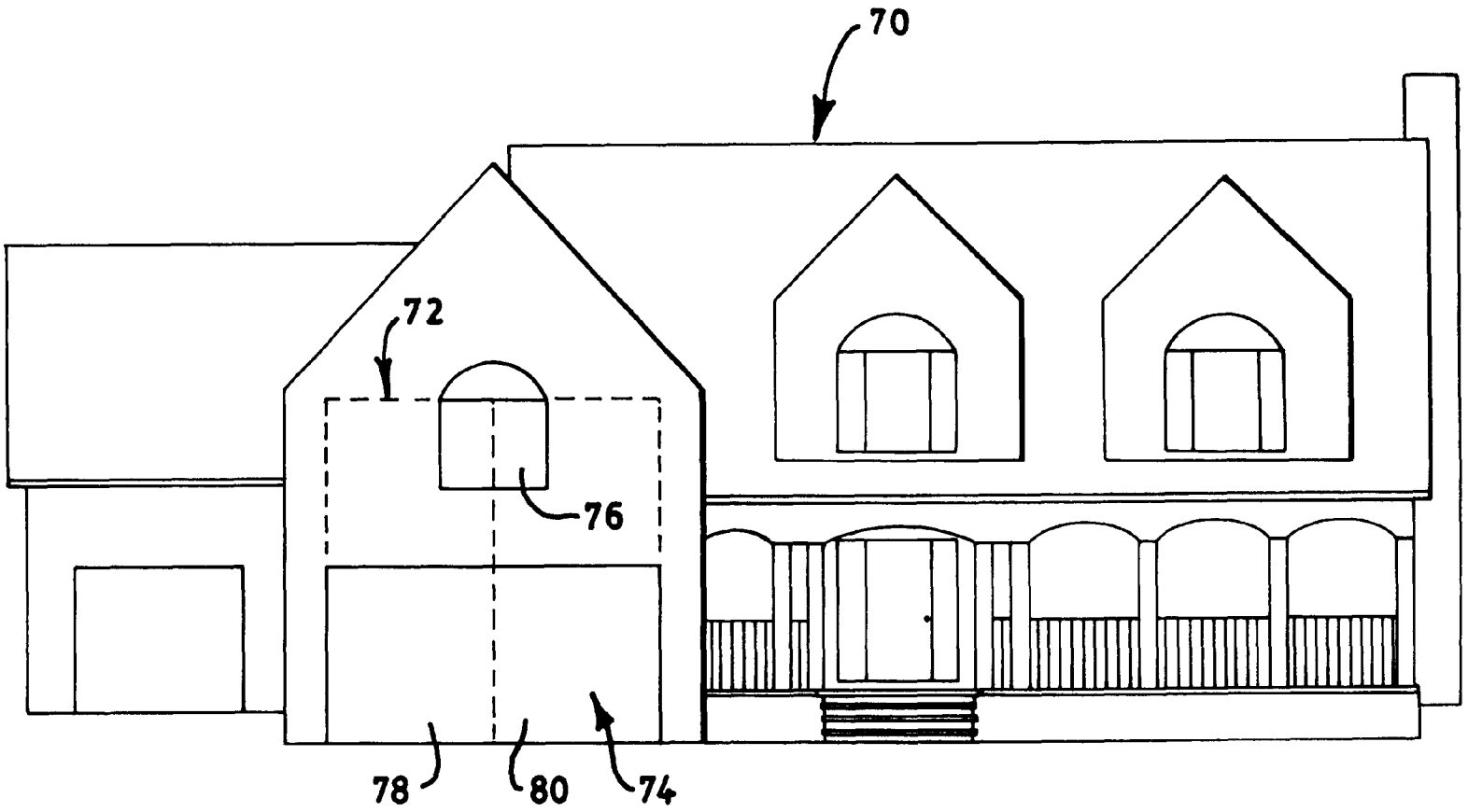
FIGS. 7A and 7B show a front view of an alternative embodiment of the invention where the oversized vehicle is fully enclosed within the housing and the housing is mechanically interconnected to the oversized vehicle from a vertical surface.
Figure 7B:
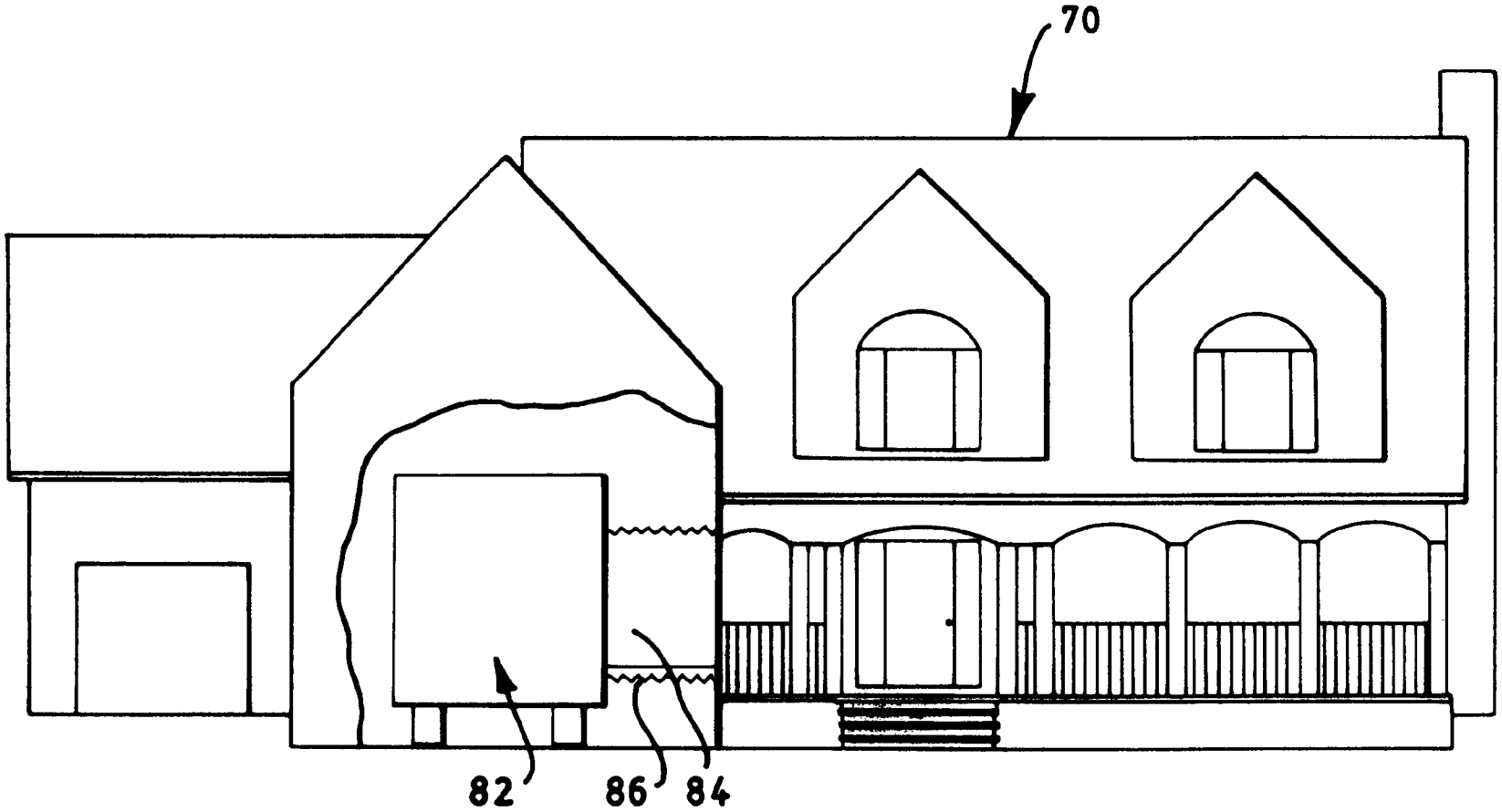

Referring now to FIGS. 7A and 7B, there is a shown a housing 70 having a set of large double doors 72 disposed therein. The large double doors 72 are constructed such that a bottom portion is a mock double garage door 74 and an upper portion of the large double door 72 has a split window 76, which when the large double door 72 is closed the split window 76 looks as if it is a single window.

The large double door 72 can be rotatably disposed so as to rotate about hinges as previously described. A first door 78 and a second door 80 then rotate in opposing directions thereby allowing access to the oversized vehicle 82. Alternatively, the large double door can retract into the housing similarly to an electric residential garage door or a commercial garage door. In such an implementation, the housing would be adapted to receive the large double door and hold the large double door after it was rotated ninety degrees. The large double door would also have to be collapsible in part in the vertical direction to retract into the housing.

In this embodiment, the oversized vehicle 82 is provided with access through the lateral surface of the oversized vehicle 82. That is, a door in the lateral surface of the oversized vehicle 82 is interconnected with the housing 70 and a platform is provided therebetween through an access way 84. As previously described, the access way 84 has a similar accordion-like structure 86 to provide a substantially airtight connection.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

The embodiments of the invention in which an exclusive property or privilege is claimed are defined as follows:

1. A dwelling system comprising:

an oversized vehicle mobily disposed and having a height greater than that of a residential garage door;

a housing having one or more doors disposed therein, the doors being actuatable to create an opening large enough to provide access to a chamber disposed within the housing such that the oversized vehicle is selectively movable into the chamber so as to fully enclose the oversized vehicle within the housing; and a garage addition which extends outward from the housing to enclose the oversized vehicle having a length that exceeds a width of the housing, the garage addition having a roof, at least a portion of which is rotatable.

2. The dwelling structure according to claim 1 wherein the housing is disposed above the oversized vehicle.

3. The dwelling structure according to claim 1 wherein the one or more doors have one or more mock doors and windows disposed therein.

4. The dwelling structure according to claim 1 wherein the housing has a first garage addition and a second garage addition, the first garage addition providing a means of ingress for the oversized vehicle and the second garage addition providing a means of egress for the oversized vehicle.

5. A dwelling system comprising:

vehicle means for transporting occupants;

housing means for housing occupants and for selectively enclosing the vehicle means within the housing means, the housing means comprising:

garage means for enclosing the vehicle means; and roof means rotatably disposed on the garage means for providing access to the garage means by the vehicle means.

6. A dwelling system comprising:

an oversized vehicle mobily disposed;

a housing having one or more doors disposed therein that are shorter than the oversized vehicle, the doors being actuatable to provide access to a chamber which is adapted to accept the oversized vehicle therein; and a roof rotatably coupled to the housing such that the roof is movable to accept to accept the oversized vehicle within the chamber.

* * * * *